United States Patent [19]

Ethridge

[11] Patent Number: 4,949,441

[45] Date of Patent: Aug. 21, 1990

[54] POLYLAMINAR APPARATUS FOR FLUID TREATMENT OF YARN

[76] Inventor: Fredrick A. Ethridge, P.O. Drawer 2547, Carmel Station, Charlotte, N.C. 28247-2547

[21] Appl. No.: 420,913

[22] Filed: Oct. 13, 1989

[51] Int. Cl.[5] ..... D02G 1/00; D02G 1/16; D02G 1/12; D02G 1/20

[52] U.S. Cl. ..... 28/271; 28/273; 28/274; 28/275; 28/281

[58] Field of Search ..... 28/271, 273, 274, 275, 28/276

[56] References Cited

U.S. PATENT DOCUMENTS

| | | | |
|---|---|---|---|
| 3,525,134 | 8/1970 | Coon | 28/273 |
| 3,633,256 | 1/1972 | Mallonee | 28/273 |
| 3,638,291 | 2/1972 | Yngve | 28/273 |
| 3,727,275 | 4/1973 | Ohayon | 28/1.4 |
| 3,849,846 | 11/1974 | Ethridge | 28/272 |
| 3,852,857 | 12/1974 | Ethridge et al. | 28/255 |
| 3,994,056 | 11/1976 | Ethridge | 29/890.142 |
| 4,063,338 | 12/1977 | Wyatt | 28/221 |

FOREIGN PATENT DOCUMENTS

| | | | |
|---|---|---|---|
| 2903508 | 11/1979 | Fed. Rep. of Germany | 28/276 |

*Primary Examiner*—Werner H. Schroeder
*Assistant Examiner*—Bibhu Mohanty
*Attorney, Agent, or Firm*—Bell, Seltzer, Park & Gibson

[57] ABSTRACT

Strand material, such as yarns, tow or film, is processed through a fluid treatment apparatus which utilizes a polylaminar stack structure to form an elongate strand processing duct which has a strand inlet, a strand outlet, and a duct cross section which changes both in breadth and in height between the inlet and outlet.

23 Claims, 4 Drawing Sheets

POLYLAMINAR APPARATUS FOR FLUID TREATMENT OF YARN

FIELD AND BACKGROUND OF THE INVENTION

This invention relates to an apparatus for continuous fluid treatment of advancing strand material such as yarns, tow or film and more particularly relates to the continuous fluid treatment of yarn or tow formed of continuous manmmade fibers.

Fluid treatment processes and apparatus have long been widely used in the processing of continuous strand materials such as yarns, fiber and tow. For example, fluid treatment jets can be used for strand transport, tension control, heat transfer, entangling, bulking or crimping of the strand material. The prior art literature abounds with disclosures of processes and apparatus for performing treatment operations such as those noted above on the continuous strand material.

Important considerations in the design and fabrication of apparatus for the fluid treatment of fiber, yarn and tow include the effectiveness of the processing geometry for the purpose at hand, the materials of construction, the economy of fabrication of the fluid treatment apparatus and the accuracy and repeatability of manufacture and assembly. Apparatus design requirements have most frequently been met using circular cross section bores which can be produced relatively inexpensively with great accuracy and repeatability and with good control of fiber, yarn or tow contact surface characteristics.

However, apparatus designs based upon circular cross section bores suffer the disadvantage that they are difficult to thread up. A free end of the stand must be threaded through the device, which requires either stopping the strand processing apparatus or using an aspirator gun to draw the strand through the bore. Slotted designs have been proposed which provide for threading the strand through the device via a permanently open slot. This allows the strand material to be strung into and through the device without the necessity of having a free end of the strand available. However, while slotted designs are easy to thread, they are capable of maintaining only slightly super atmospheric internal pressure. This significantly restricts the extent of fluid treatment which can be achieved in such designs.

To overcome the above problems, U.S. Pat. No. 3,525,134 proposed a fluid treatment apparatus which was of a closeable construction and which utilized a rectangular cross section bore. However, it is quite difficult and expensive to machine uniform rectangular bores with sharp interior corners and uniform surface characteristics within the narrow confines of the bore. Consequently, there are significant practical and economical limitations to this type of fluid treatment apparatus.

My earlier U.S. Pat. Nos. 3,849,846 and 3,994,056 disclosed a continuous strand fluid treatment apparatus which was readily threadable, enabled control of interior contact surface characteristics, did not suffer an undesirable interior flow disruption, and did not trap or snag running strands. This design utilized a trilaminar sandwich structure comprising a yarn treatment duct having at least one fluid entry port thereto, with the duct being formed by a discontinuous inner lamina between two continuous outer laminae. The individual laminae can be readily manufactured and subjected to surface finishing operations prior to final assembly. Then the individual components can be assembled to form a yarn processing duct of the desired configuration.

While the designs set forth in U.S. Pat. Nos. 3,849,846 and 3,994,056 represented a significant advance over previous designs, some limitations remained. In particular, the trilaminar design of these patents cannot accommodate the complex interior geometry requirements of advanced fluid treatment apparatus, such as that set forth in U.S. Pat. No. 3,852,857. The circular cross section strand treatment duct of the '857 patent undergoes several diametrical changes, including a transition from a relatively small diameter entrance zone to an enlarged crimping chamber which produces pneumatic stuffer box crimping of the strand material. The trilaminar designs of the '846 and '056 patents can accommodate simple one dimensional changes in duct cross section, but one duct cross section dimension must remain constant at the thickness of the discontinuous inner lamina.

SUMMARY

With the foregoing in mind it is an object of the present invention to provide an apparatus for the fluid treatment of continuous strand material which will accommodate complex cross sectional configurations of the strand processing duct.

More particularly, it is an object of the present invention to provide an apparatus for the fluid treatment of continuous strand material which is readily threadable, enables control over the strand contact surface characteristics, and which will accommodate rectilinear cross section processing ducts which simultaneously or separately expand or contract in the breadth and/or height dimensions.

In accordance with the present invention an improved readily threaded apparatus for the fluid treatment of continuous strand materials such as yarns, tow or film is provided which uses a polylaminar stack structure. The fluid treatment apparatus includes a body member, a cover plate, and a stack of laminae held in assembled relationship between opposing surfaces of the body member and cover plate. The laminae of the stack cooperate to define an elongate processing duct for the advancing strand material, with the processing duct have a strand inlet and a strand outlet and a duct cross section which changes both in breadth and in height between the inlet and outlet.

The polylaminar stack structure makes it possible to provide strand processing ducts of various complex cross sectional configurations. The individual laminae can be readily manufactured by conventional machining techniques and the individual laminae can be thereafter assembled to form a yarn processing duct of the desired configuration and complexity. A particularly advantageous feature of the invention which is achieved through the use of the polylaminar stack structure is the ability to produce a yarn processing duct which changes in both the breadth and height dimensions.

The detailed description which follows describes an example of one particular type of strand processing apparatus which produces a uniformly bulked strand material at high speeds through the use of a pneumatic stuffer box crimping process. U.S. Pat. No. 3,852,857 discloses a fluid treatment apparatus of an earlier design which produces a pneumatic stuffer box crimping of strand material. However, this design requires that a free end of the strand be threaded through the device, which as noted earlier, requires either stopping the strand processing apparatus or using an aspirator gun to draw the strand through the bore. The present invention on the other hand is readily threadable since the device can be opened up to permit threading of the strand into the elongate strand processing without requiring a free end of the strand material.

The present invention will be described more fully hereinafter with reference to the accompanying drawings, in which illustrative embodiments of the invention are shown. This invention can, however, be embodied in many different forms and the invention should not be construed as being limited to the specific embodiments set forth herein. Rather, applicant provides these embodiments so that this disclosure will be thorough and complete and will fully convey the scope of the invention to those skilled in the art.

DESCRIPTION OF ILLUSTRATED EMBODIMENT

Figure 1:
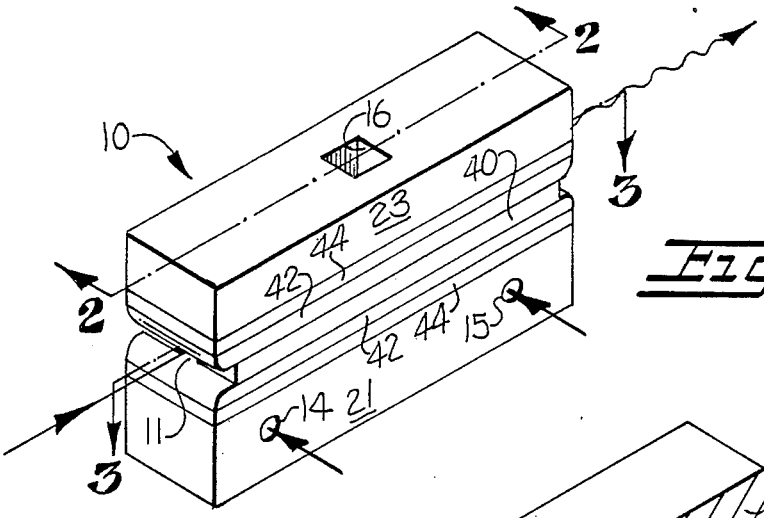
FIG. 1 is a perspective view of a strand fluid treatment apparatus in accordance with one exemplary embodiment of the invention.

Referring now more particularly to the drawings, the fluid treatment apparatus is indicated by the reference character 10. As illustrated, one longitudinal end of the apparatus has a strand inlet opening 11 for receiving the strand material to be processed. The advancing strand material travels through an elongate strand processing duct 12 and exists the apparatus at the opposite end of the apparatus via a strand outlet opening 13. Pressurized fluids are supplied to the fluid treatment apparatus 10 via fluid supply ports 14,15 and spent fluids exit the apparatus via fluid discharge ports 16,17. As the strand material passes through the apparatus, the treatment fluids act upon the strand material to impart texture or crimps, as explained more fully below.

Figure 2:
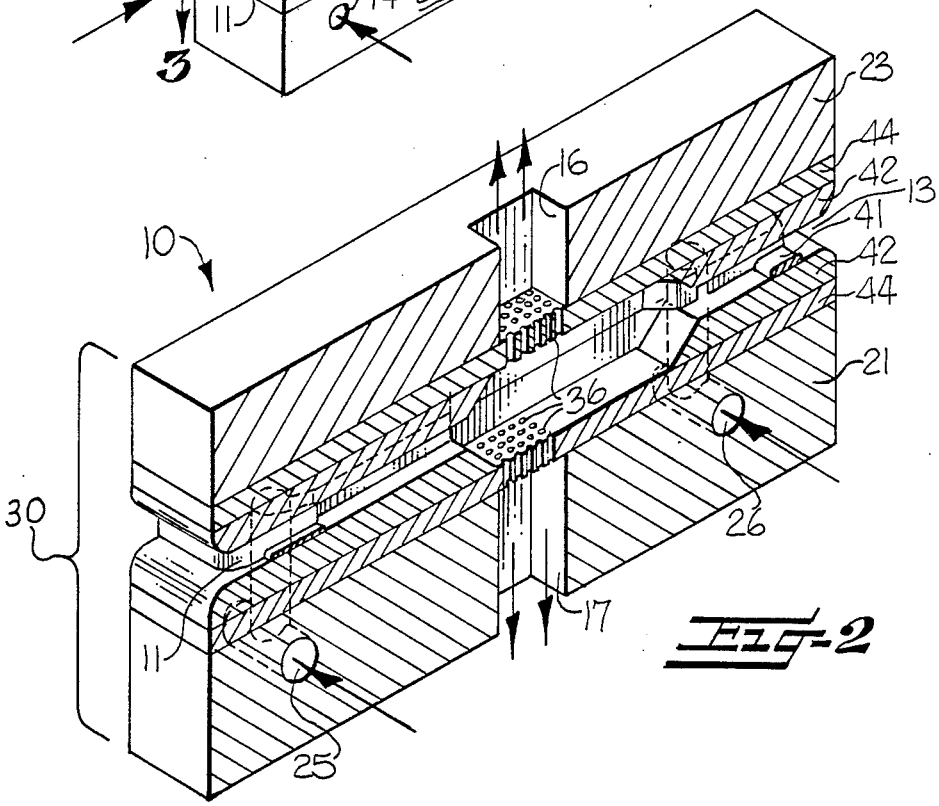
FIG. 2 is a cross sectional perspective view of the fluid treatment apparatus taken substantially at the plane 2—2 of FIG. 1.

As seen in FIG. 2, the fluid treatment apparatus includes body member 21 having a substantially planar upper surface. The apparatus also includes a cover plate 23 having a substantial planar lower surface. Sandwiched between the upper surface of body member 21 and the lower surface of cover plate 23 is a stack of laminae indicated generally by the reference character 30. The polylaminar stack forms the elongate strand processing duct 12. The fluid supply ports 14,15 (FIG. 1) communicate with laterally extending fluid supply bores 25,26 formed in the body member 21. A pair of laterally spaced apart, upwardly extending fluid supply bores *27a*, *27b* (FIG. 4) communicate with the fluid supply bore 25 adjacent the inlet end of the apparatus, while a pair of laterally spaced apart, upwardly extending fluid supply bores *28a,28b* communicate with the fluid supply bore 26 adjacent the discharge end of the apparatus. The fluid supply bores *27a*, *27b* supply pressurized fluid to a pair of strand advancing jets 31 (FIG. 3) located adjacent the strand inlet opening 11, which serve to propel the strand material into the elongate strand processing duct 12. The fluid supply bores *28a*, *28b* supply pressurized fluid to a pair of strand retarding jets 32 located adjacent the strnd discharge opening 12.

Figure 3:
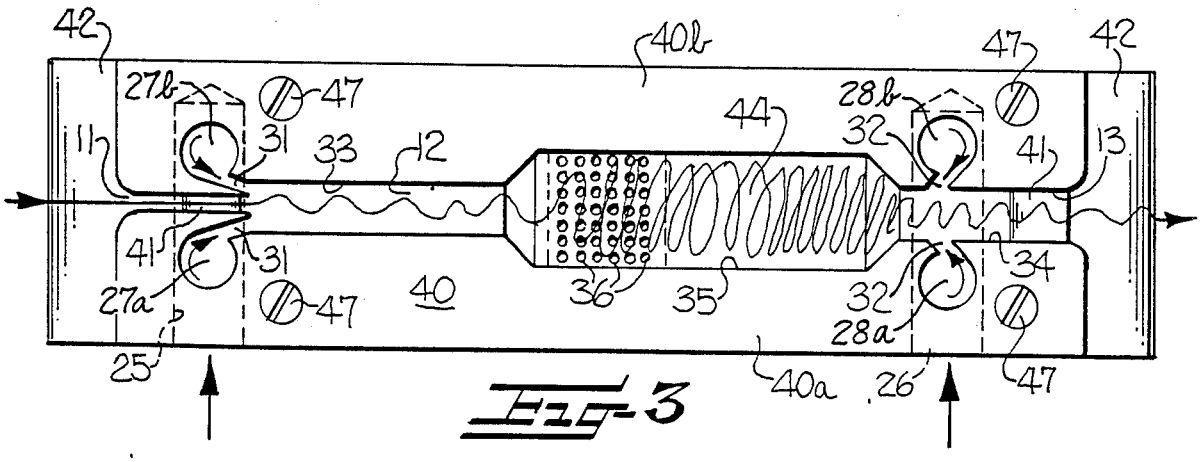
FIG. 3 is a cross sectional view of the fluid treatment apparatus taken substantially at the plane 3—3 of FIG. 1.

As best seen in FIGS. 2 and 3, the cross sectional area of strand processing duct 12 varies along the length of the duct. At the entrance end 11, the duct is of a relatively small cross section sufficient to admit the advancing strand while limiting any significant discharge of pressurized fluid from the entrance end 11. The duct then increases in breadth for a distance along an entrance zone 33 (FIG. 3) after the strand advancing jets 31. The duct is of a generally similar cross section in an exit zone 34 at the downstream extremity of duct between the strand retarding jets 32 and the discharge end 13. Between the entrance zone 33 and the exit zone 34 of the duct is a crimping chamber or zone 35 which is of increased breath and height. The crimping chamber 35 is provided with perforations 36 which allow fluid from the strand advancing jets 31 and the strand retarding jets 32 to exit the crimping chamber to the discharge ports 16,17.

In operation, strand material, such as a yarn, advances from a supply package into the entrance end 11 of the apparatus 10. A heated fluid, such as air or steam, is supplied to port 14 and is discharged from the strand advancing jets 31 to propel the strand forwardly into the crimping zone 35, where the strand material accumulates upon itself and is compacted into a plug to form crimps. Meanwhile, a cooling fluid, such as compressed air, is supplied to port 15 and is discharged from the retarding jets 32 to cool and set the strand material in the crimped condition, while providing back pressure and a compressive force on the plug. The crimped strand material is withdrawn from the discharge end 13 of the apparatus.

Figure 4:
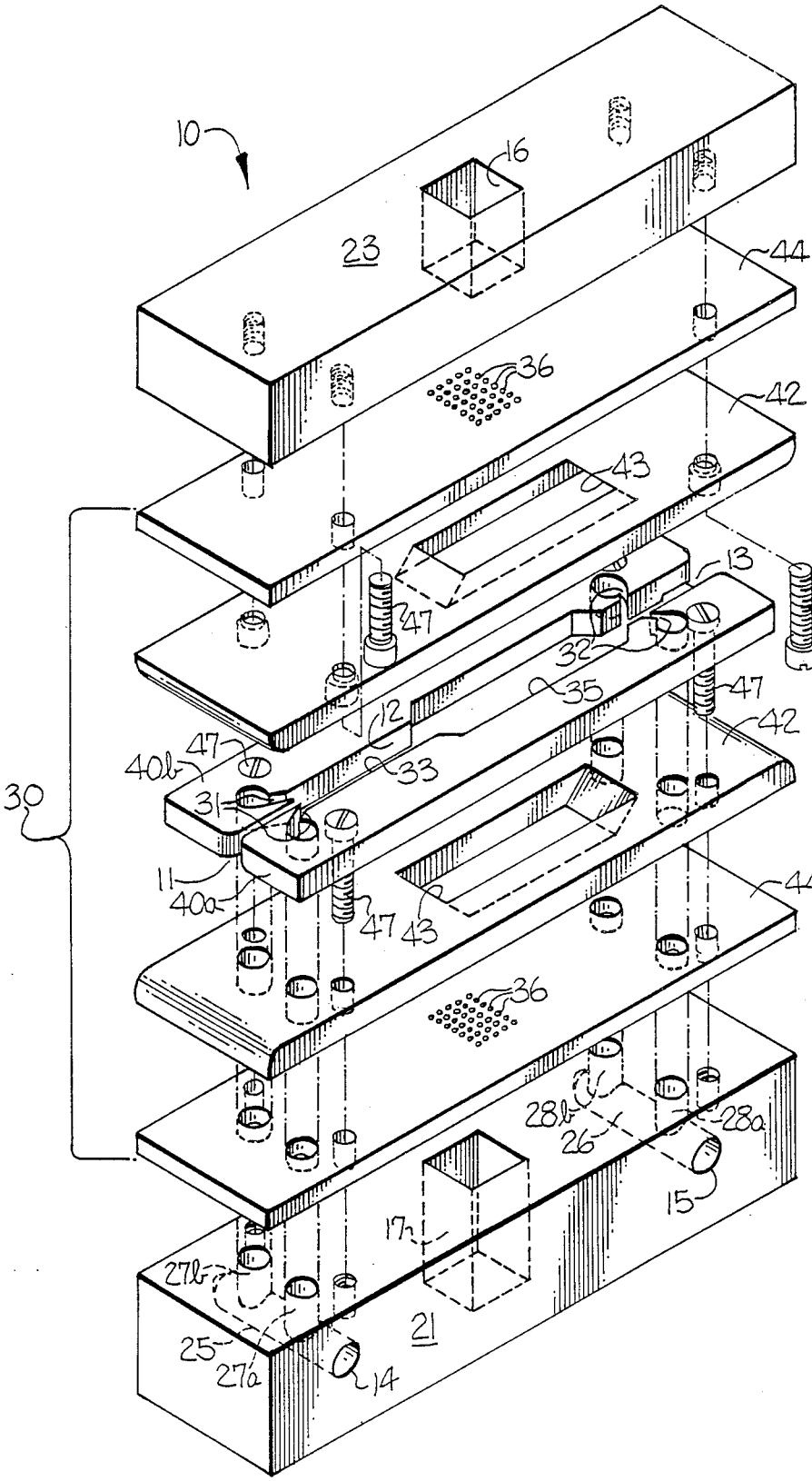
FIG. 4 is a perspective view of the fluid treatment apparatus of FIG. 1 which has been exploded to more clearly illustrate the various laminae.

As will be seen most clearly from FIG. 4, the elongate strand processing duct 12 is formed by the cooperating laminae of the stack 30. The stack 30 includes a central lamina 40 which has an elongate longitudinally extending slot-like opening formed in a medial portion thereof which extends from one longitudinal end of the lamina to the opposite end. The slot-like opening defines the longitudinally extending side walls of the elongate strand processing duct 12. The central lamina 40 is of a unitary one-piece construction formed by machining the slot-like opening in a plate of substantially uniform thickness. The central lamina 40 is symmetrical about a line of symmetry extending longitudinally along the slot-like opening, with its two longitudinal halves 40*a*, 40*b* being joined together by web portions 41 of reduced thickness.

On opposite sides of the central lamina 40 are intermediate laminae 42. As illustrated, the intermediate laminae have a central opening 43 formed therein which overlies the crimping zone 35, thereby providing the increased height dimension in the crimping zone. Outer laminae 44 are located on oppostite sides of the intermediate laminae 42 and adjacent the body member 21 and cover plate 23 respectively. Perforations 36 are formed in the outer laminae 44 overlying the openings 43 in the intermediate laminae 42.

To faciliate threading the strand material through the elongate strand processing duct 12, the body member 21 and the cover plate 23 are mounted so that they can be moved apart from one another. As illustrated, the central lamina 40, the underlying intermediate lamina 42, and the underlying outer lamina 44 are secured as a unit to the body member 21 by suitable means, such as screws 47. The uppermost intermediate lamina 42 and the uppermost outer lamina 44 are secured to the cover plate 23 by suitable means, such as screws 47. Thus, when the body member 21 and cover plate 23 are moved apart from one another, the strand material can be readily positioned in the elongate strand duct 12 without requiring that a free end of the strand material be accessible for threading into the entry end 11.

Figure 5:
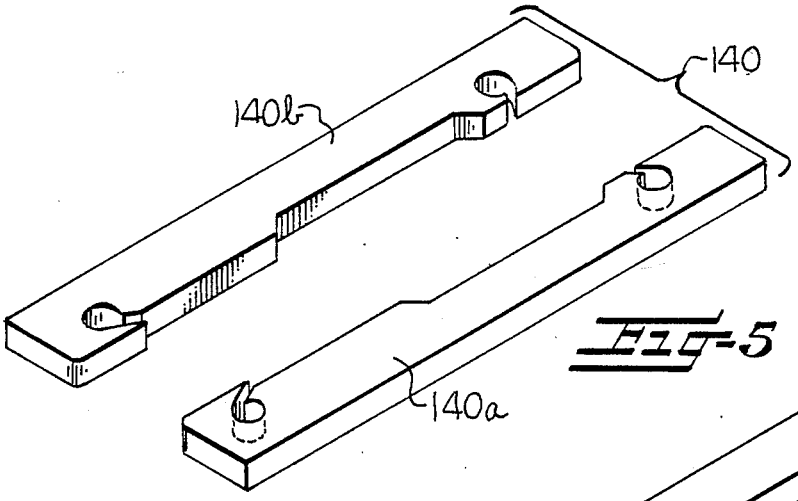
FIGS. 5 and 6 are perspective views showing two alternative embodiments of laminae which can be used in the fluid treatment apparatus.
Figure 6:
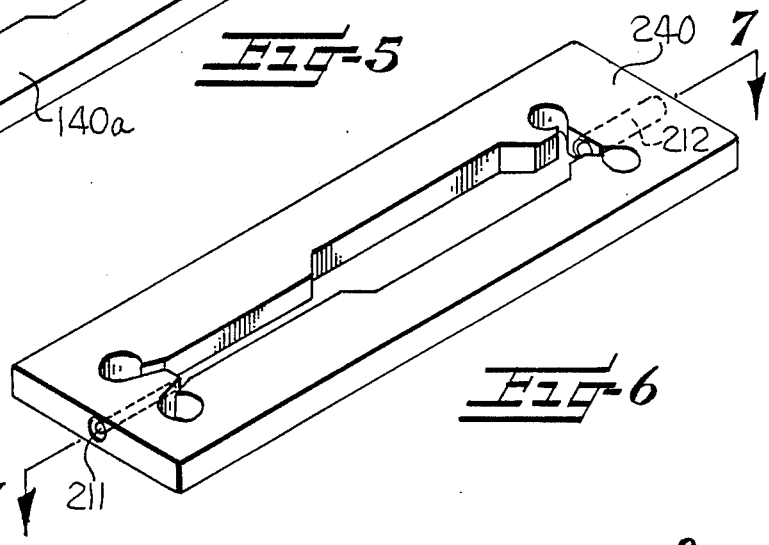
Figure 7:
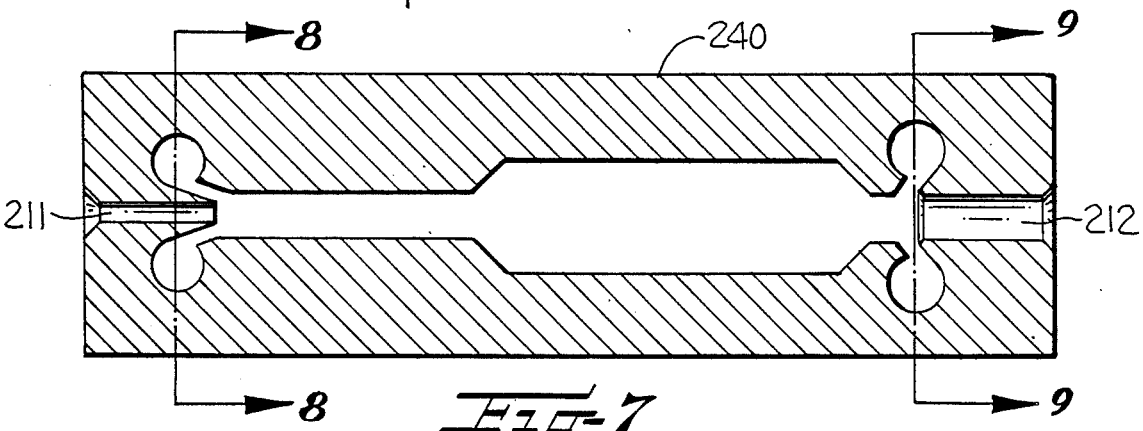
FIG. 7 is a longiutudinal cross sectional view of the lamina of FIG. 6 taken substantially at the plane 7—7.
Figure 8:
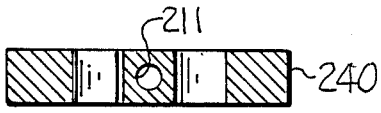
FIG. 8 is a transverse cross sectional view taken substantially at the plane 8—8 of FIG. 7.
Figure 9:
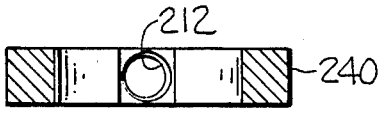
FIG. 9 is a transverse cross sectional view taken substantially at the plane 9—9 of FIG. 7.

FIGS. 5 and 6 illustrate some alternate constructions for the central lamina 40. As shown in FIG. 5, the central lamina 140 is discontinuous, comprising two separate halves 140*a*, 140*b*. The cooperating halves are mounted in spaced apart relation to partially define the elongate strand processing duct 12. In the alternate construction illustrated in FIG. 6, the central lamina 240 is formed from a single unitary plate, with the elongate slot-like opening and jets being formed in the plate by machining. In this embodiment the entry end 211 and the discharge end 212 are defined by bores formed in the plate and extending along the longitudinal axis of symmetry. This embodiment has the advantage of being somewhat easier to manufacture, but it requires that a free end of the strand be accessible for threading into the entry end 11 of the elongate strand processing duct 12.

The drawing figures and accompanying description thus far have explained the construction and operation of a fluid treatment apparatus having a single elongate strand processing duct. However, the features and principles of this invention can be effectively utilized in forming fluid treatment devices designed for processing multiple strands. Two or more elongate strand processing jets can be formed in a single lamina so that multiple strands can be accommodated. Similarly, the apparatus can be of a double sided construction, sharing a common body member so that additional strand processing capacity can be provided in a single unit. One possible such arrangement is illustrated in FIGS. 10–13. To avoid repetitive description, elements which correspond to those previously described in the previous embodiment will be identified by corresponding reference numbers, with prime notation and/or letter suffixes added.

Figure 10:
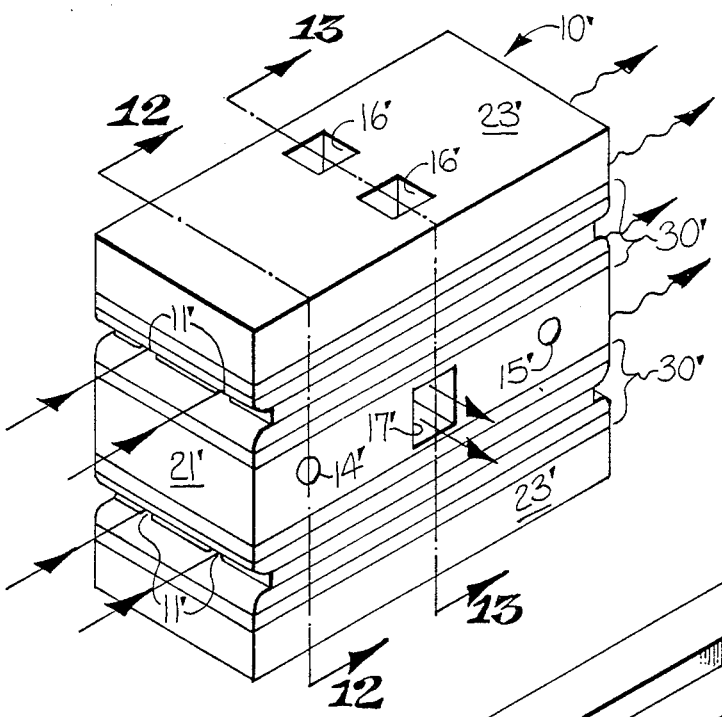
FIG. 10 is a perspective view of a strand fluid treatment apparatus in accordance with an alternate embodiment of the invention.

The strand treatment apparatus 10' illustrated in FIG. 10 is designed for processing four strands simultaneously. The apparatus has a body member 21' having substantially planar upper and lower surfaces. Cover plates 23' are located adjacent the top and bottom of the apparatus. Sandwiched between the upper cover plate 23' and the upper surface of body member 21' is a first stack 30' of laminae, while a similar stack 30' is also sandwiched between the lower surface of the body member 21' and the upper surface of the lower cover plate 23'l.

Figure 11:
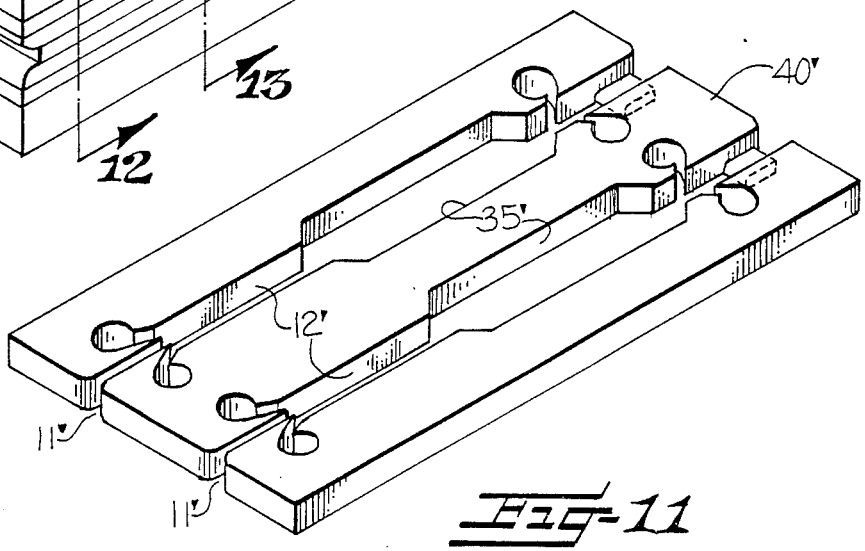
FIG. 11 is a perspective view of one of the laminae of the strand treatment apparatus of FIG. 10.

FIG. 11 illustrates the construction of the central lamina 40' used in each stack. As illustrated, it is provided with a pair of longitudinally extending slot-like openings which form a pair of side by side elongate strand procesing ducts 12'.

Figure 12:
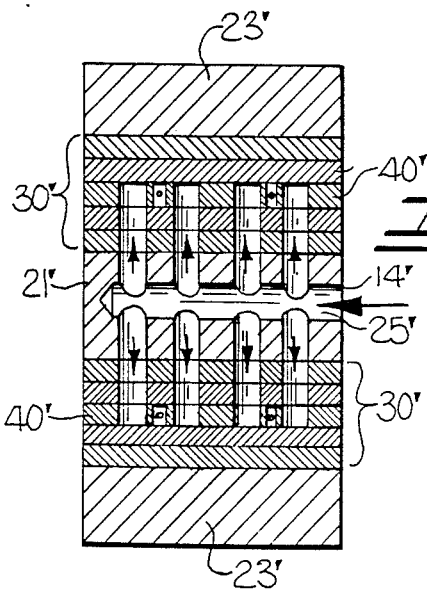
FIG. 12 is a cross sectional view taken substantially at the plane 12—12 of FIG. 10.
Figure 13:
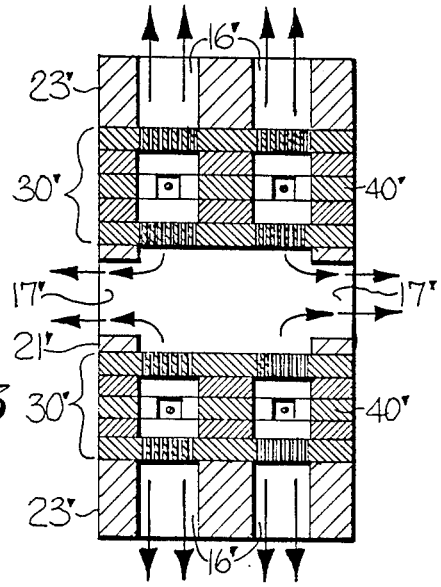
FIG. 13 is a cross sectional view taken substantially at the plane 13—13 of FIG. 10.

As seen in FIG. 12, the fluid supply ports 14',15' and associated laterally extending fluid supply bores 25',26' serve both the upper and lower stacks of laminae. As shown in FIG. 13, a common discharge port 17' extends laterally through the body portion, and discharge ports 16' are formed in the upper and lower cover plates 23'.

The apparatus shown in FIG. 10 can be readily threaded without requiring the free ends of the strand material by mounting the body member 21' in a stationay position and mounting the upper and lower cover plates 23' so that they can be moved slightly apart from the body member 21' to provide access to the elongate strand ducts 12'.

The foregoing description is to be considered illustrative rather than restrictive of the invention, and those modifications which come within the meaning and range of equivalence of the claims are to be included therein.

That which I claim is:

1. Apparatus for fluid treatment of advancing strand material such as yarn, tow, or film, comprising a body member, a cover plate, and a stack of laminae held in assembled relationship between opposing surfaces of said body member and said cover plate, said laminae cooperating to define an elongate processing duct fo the advancing strand material, said processing duct having a strand inlet and a strand outlet and a duct cross section which changes both in breadth and in height between said inlet and outlet, and said apparatus including at least one fluid entry port for supplying treatment fluid to said processing duct.

2. Apparatus according to claim 1 wherein the opposing surfaces of said body member and said cover plate are substantially planar and the laminae in said stack are of a thin, substantially planar configuration.

3. Apparatus according to claim 1 wherein the laminae in said stack are of a thin, substantially planar configuration, and wherein one of said laminae has an elongate longitudinally extending slot-like opening formed in a medial portion thereof to define longitudinally extending side walls of said elongate strand processing duct, said slot-like opening having a width which varies to define a zone of increased breadth dimension in said elongate strand processing duct.

4. Apparatus according to claim 3 wherein said one lamina is of a one-piece construction.

5. Apparatus according to claim 3 wherein said one lamina is defined by a pair of thin elongate cooperationg plates of substantially uniform thickness, said cooperationg plates having edge portions disposed in opposing spaced apart relationship to define longitudinally extending side walls of said elongate strand processing duct.

6. Apparatus according to claim 3 wherein said stack of laminae also includes a thin plate of substantially uniform thickness overlaying at least one side of said one lamina and defining a longitudinally extending lateral wall of said elongate strand processing duct, said plate having a hole formed therein at a location adjacent said strand processing duct and defining a zone of increased height dimension in said elongate strand processing duct.

7. Apparatus according to claim 1 including a first bore formed in said body member and opening onto said surface thereof to define a first fluid supply port, and including means formed in at least one of the laminae of said stack defining a strand advancing jet communicationg with said first fluid supply port.

8. Apparatus according to claim 7 including a second bore formed in said body member and opening onto said surface thereof at a spaced location from said first fluid supply port to define a second fluid supply port, and including means formed in at least one of the laminae of said stack defining a strand retarding jet communicationg with said second fluid supply port.

9. Apparatus according to claim 8 including a third bore formed in said body member and opening onto said surface thereof at a location between said first and second fluid supply ports and defining an exhaust port for spent fluid, and including means formed in at least one of the laminae of said stack providing fluid communication between said elongate strand processing duct and said fluid exhaust port.

10. Apparatus according to claim 9 including a bore formed in said cover plate and opening onto said surface thereof at a location generally opposite said third bore in said body member and defining an additional exhaust port for spent fluid.

11. Apparatus for fluid treatment of strand material such as yarns, tow, or film, comprising a body member having a substantially planar upper surface, a stack of assembled laminae overlying said upper surface of said body member and cooperating to define an elongate strand processing duct having a strand inlet and a strand outlet and a duct cross section which changes both in breadth and in height between said inlet and outlet, and a cover plate overlying said stack of laminae and holding the stack of laminae in assembled relationship, one of the lamina of said stack including plate means having portions thereof disposed in opposing spaced apart relationship to define side walls of said elongate strand processing duct extending longitudinally between said strand inlet and said strand outlet, and including cooperating recesses formed in the opposing longitudinal edge portion said plate means and defining a zone of increased breadth dimension in said elongate strand processing duct, another of the lamina of said stack comprising a thin plate of substantially uniform thickness overlying one side of said one lamina and defining a longitudinally extending lateral wall of said elongate strand processing duct, said plate having an opening formed therein at a location adjacent said strand processing duct and defining a zone of increased height dimension in said elongate strand processing duct.

12. Apparatus according to claim 11 wherein said plate means having edge portions disposed in spaced apart relationship plate to define side walls of said strand processing duct comprises an integral thin plate of substantially uniform thickness, with an elongate longitudinally extending slot-like opening formed in the plate and defining said walls of said elongate strand processing duct.

13. Apparatus according to claim 11 wherein said plate means having edge portions disposed in spaced apart relationship plate to define side walls of said strand processing duct comprises a cooperating pair of thin elongate plates of equal and substantially uniform thickness arranged in opposing spaced apart relationship, with opposing longitudinal edge portions thereon spaced apart from one another to define said side walls of said elongate strand processing duct.

14. Apparatus according to claim 11 wherein a stack of assembled laminae includes means defining a plurality of elongate strand processing ducts, each having a strand inlet and a strand outlet and a duct cross section which changes both in breadth and in height between said inlet and outlet.

15. Apparatus according to claim 11 wherein said body members also has a substantially planar lower surface, and said apparatus additionally includes a stack of assembled laminae underlying said lower surface of said body member and cooperating to define an elongate strand processing duct having a strand inlet and a strand outlet and a duct cross section which changes both in breadth and in height between said inlet and outlet, and a cover plate underlying said stack of laminae and holding the stack of laminae in assembled relationship.

16. Apparatus for fluid treatment of strand material such as yarns, tow, or film, comprising a body member having a substantially planar upper surface, a first bore formed in said body member and opening onto said surface thereof to define a first fluid supply port, a second bore formed in said body member and opening onto said surface thereof at a spaced location from said first fluid supply port to define a second fluid supply port, a third bore formed in said body member and opening onto said surface thereof at a location between said first and second fluid supply ports and defining an exhaust port for spent fluid, a stack of assembled laminae overlying said upper surface of said body member and cooperationg to define an elongate strand processing duct having a strand inlet and a strand outlet and a duct cross section which changes both in breadth and in height between said inlet and outlet, said stack of laminae including.

a central lamina comprised of a thin elongate plate having an elongate longitudinally extending slot-like opening formed in a medial portion thereof to define longitudinally extending side walls of said elongate strand processing duct, and including cooperating recesses formed in said longitudinally extending side walls and defining a zone of increased breadth dimension in said elongate strand processing duct, intermediate laminae formed of a thin plate of substantially uniform thickness positioned overlying opposite sides of said central lamina and defining opposed, spaced apart longitudinally extending lateral walls of said elongate strand processing duct, said intermediate laminae each having an opening formed therein at a location adjacent said strand processing duct and defining a zone of increased height dimesion in said elongate strand processing duct, an outer lamina formed of a thin plate positioned adjacent said surface of said body member and having perforations formed therein overlying said exhaust port to allow the discharge of exhaust fluid from said strand processing duct, and a cover plate overlying said stack of laminae and holding the stack of laminae in assembled relationship.

17. Apparatus for fluid treatment of strand material such as yarns, tow, or film, comprising a body member having a substantially planar upper surface, a first bore formed in said body member and opening onto said surface thereof to define a first fluid supply port, a second bore formed in said body member and opening onto said surface thereof at a spaced location from said first fluid supply port to define a second fluid supply port, a third bore formed in said body member and opening onto said surface thereof at a location between said first and second fluid supply ports and defining an exhaust port for spent fluid, a stack of assembled laminae overlying said upper surface of said body member and cooperating to define an elongate strand processing duct having a strand inlet and a strand outlet and a duct cross section which changes both in breadth and in height between said inlet and outlet, said stack of laminae including a central lamina comprised of a cooperating pair of thin elongate plates of equal and substantially uniform thickness, said cooperating plates having edge portions disposed in opposing spaced apart relationship to define side walls of said elongate strand processing duct extending longitudinally between said strand inlet and said strand outlet, and including cooperating recesses formed in the opposing longitudinal edge portion said plates and defining a zone of increased breadth dimension in said elongate strand processing duct, intermediate laminae formed of a thin plate of substantially uniform thickness positioned overlying opposite sides of said central lamina and defining opposed, spaced apart longitudinally extending lateral walls of said elongate strand processing duct, said intermediate laminae each having a hole formed therein at a location adjacent said strand processing duct and defining a zone of increased height dimension in said elongate strand processing duct, an outer lamina formed of a thin plate positioned adjacent said surface of said body member and having perforation formed therein overlying said exhaust port to allow the discharge of exhaust fluid from said strand processing duct, and a cover plate overlying said stack of laminae and holding the stack of laminae in assembled relationship.

18. Apparatus according to claim 16 or 17 including means formed in said central lamina defining a strand advancing jet located between said strand inlet and said zone of increased dimension, said strand advancing jet communicating with said first fluid supply port, and means formed in said central lamina defining a strand retarding jet located between said strand outlet and said zone of increased breadth and height dimension, said strand retarding jet communicating with said second fluid supply port.

19. A method for fluid treatment of advancing strand material such as yarns, tow, or film, comprising directing a strand material along a path of travel and into and through an elongate processing duct defined by a stack of laminae held in assembled relationship between a body member and a cover plate, said processing duct having a strand inlet and a strand outlet and a duct cross section which changes both in breadth and in height between said inlet and outlet, and directing pressurized fluid from at least one fluid entry port into the elongate duct and into engagement with the advancing strand material and deforming the strand material as it passes through the processing duct.

20. A method according to claim 19 wherein the laminae in the stack are of a thin, substantially planar configuratin, and wherein one of the laminae has an elongate longitudinally extending shot-like opening formed in a medial portion thereof to define longitudinally extending side walls of the elongate strand processing duct, said shot-like opening having a width which varies to define a zone of increased breadth dimension in the elongate strand processing duct.

21. A method for fabricating a fluid treatment apparatus of the type having a strand inlet, a strand outlet, and an elongate strand processing duct between the inlet and outlet fluid treatment of advancing strand material such as yarns, tow, or film, said method comprising positioning between opposing surfaces of a body member and a cover plate, a stack of laminae held in assembled relationship between opposing surfaced of said body member and said cover plate, said laminae cooperating to define an elongate processing duct for the advancing strand material, said processing duct having a strand inlet and a strand outlet and a duct cross section which changes both in breath and in height between said inlet and outlet, and said apparatus including at least one fluid entry port for supplying treatment fluid to said processing duct.

22. A method for fabricating a fluid treatment apparatus of the type having a strand inlet, a strand outlet, and an elongate strand processing duct between the inlet and outlet for receiving advancing strand material such as yarns, tow, or film, and imparting fluid treatment thereto, said method comprising providing a thin, substantially planar central lamina having an elongate longitudinally extending slot-like opening formed in a medial portion thereof to define longitudinally extending side walls of the elongate strand processing duct, said slot-like opening having a width which varies to define a zone of increased breadth dimension in the elongate strand processing duct, assembling the central lamina between a pair of thin, substantially planar outer laminae having a medial opening formed therein and cooperating with the elongate slot-like opening of said centrol lamina to define a zone of increased height dimension in the elongate strand processing duct such that the cross section of the elongate strand processing duct changes both in breadth and in height between the strand inlet and the strand outlet.

23. A method according to claim 22 wherein the medial opening in each said outer laminae is so located that the cross section of the elongate strand processing duct also increases in height dimension in said zone of increased breadth dimension.

* * * * *

UNITED STATES PATENT AND TRADEMARK OFFICE

CERTIFICATE OF CORRECTION

PATENT NO. : 4,949,441

DATED : August 21, 1990

INVENTOR(S) : Fredrick Allen Ethridge

It is certified that error appears in the above-identified patent and that said Letters Patent is hereby corrected as shown below:

Column 1, line 11, "manmmade" should be -- manmade --.

Column 1, line 35, "stand" should be -- strand --.

Column 2, line 49, "have" should be -- having --.

Column 3, line 9, after "processing" insert -- duct --.

Column 3, line 39, "longiutudinal" should be -- longitudinal --.

Column 3, line 63, "exists" should be -- exits --.

Column 4, line 26, "strnd" should be -- strand --.

Column 4, line 40, "breath" should be -- breadth --.

Column 5, line 12, "oppostite" should be -- opposite --.

Column 5, line 17, "faciliate" should be -- facilitate --.

Column 6, line 5, after "surface of" insert -- the --.

Column 6, line 9, "23'1" should be -- 23' --.

Column 6, line 21, after "are" insert -- also --.

Column 6, lines 23-24, "stationay" should be -- stationary --.

UNITED STATES PATENT AND TRADEMARK OFFICE

CERTIFICATE OF CORRECTION

PATENT NO. :4,949,441

DATED :August 21, 1990

INVENTOR(S) :Fredrick Allen Ethridge

It is certified that error appears in the above-identified patent and that said Letters Patent is hereby corrected as shown below:

Column 6, line 36, "yarn" should be -- yarns --.

Column 6, line 40, "fo" should be -- for --.

Column 6, line 63, "cooperationg" should be -- cooperating --.

Column 6, lines 64-65, "cooperationg" should be -- cooperating --.

Column 7, line 3, "overlaying" should be -- overlying --.

Column 7, lines 14-15, "communcationg" should be -- communicating --.

Column 7, lines 21-22, "communcationg" should be -- communicating --.

Column 8, line 23, "members" should be -- member --.

Column 8, line 50, "cooperationg" should be -- cooperating --.

Column 8, line 55, after "including" delete -- . --.

Column 9, line 5, "dimesion" should be -- dimension --.

Column 10, line 14, after "elongate" insert -- processing --.

UNITED STATES PATENT AND TRADEMARK OFFICE

CERTIFICATE OF CORRECTION

PATENT NO. : 4,949,441

DATED : August 21, 1990

INVENTOR(S) : Fredrick Allen Ethridge

It is certified that error appears in the above-identified patent and that said Letters Patent is hereby corrected as shown below:

Column 10, line 20, "configuratin" should be -- configuration --.

Column 10, line 21, "shot-like" should be -- slot-like --.

Column 10, line 24, "shot-like" should be -- slot-like --.

Column 10, line 34, "surfaced" should be -- surfaces --.

Column 10, line 39, "breath" should be -- breadth --.

Signed and Sealed this

Fifth Day of May, 1992

*Attest:*

*Attesting Officer*

DOUGLAS B. COMER

*Acting Commissioner of Patents and Trademarks*